US006478114B2

(12) United States Patent
Ito et al.

(10) Patent No.: US 6,478,114 B2
(45) Date of Patent: Nov. 12, 2002

(54) LUBRICATING SYSTEM OF INTERNAL COMBUSTION ENGINE

(75) Inventors: Katsuhiko Ito, Saitama (JP); Nobuyuki Yakigaya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/867,391

(22) Filed: May 31, 2001

(65) Prior Publication Data

US 2002/0007984 A1 Jan. 24, 2002

(30) Foreign Application Priority Data

May 31, 2000 (JP) ..... 2000-162987

(51) Int. Cl.[7] ..... F01M 1/04

(52) U.S. Cl. ..... 184/6.5; 184/106; 74/606 R; 123/90.3 B

(58) Field of Search ..... 184/106, 6.5; 74/606 R; 123/90.37, 90.38, 196 R

(56) References Cited

U.S. PATENT DOCUMENTS 5,601,060 A * 2/1997 Smietanski et al. ..... 123/195 C
5,954,022 A * 9/1999 Katayama et al. ..... 123/195 P
6,041,752 A * 3/2000 Van Klompenburg ... 123/195 C
6,257,193 B1 * 7/2001 Alpan et al. ..... 123/196 R

FOREIGN PATENT DOCUMENTS

JP 62-49448 10/1987

* cited by examiner

*Primary Examiner*—David Fenstermacher
(74) *Attorney, Agent, or Firm*—Birch, Stewart, Kolasch & Birch, LLP

(57) ABSTRACT

A crankcase with a ceiling portion for shutting off the upper side of an oil pool chamber. An oil flowing window is opened in the ceiling portion of a right case. An oil strainer is formed in a flat plate like shape. The oil strainer is fitted to the oil flowing window. The right case is provided with an oil passage through which the oil having passed through the oil strainer flows roughly horizontally to an oil pump suction port. The ceiling portion of the right case is provided with a cutout portion by not casting a portion of the case at a position where the ceiling portion of the right case and an oil pump are adjacent to each other, and a plug is fitted in the cutout portion. The vertical size from the oil pool to the oil pump suction port can be reduced as much as possible, and the overall height of the internal combustion engine can be restricted.

16 Claims, 6 Drawing Sheets

LUBRICATING SYSTEM OF INTERNAL COMBUSTION ENGINE

BACKGROUND OF THE INVENTION

1. Field of the Invention

The present invention relates to a lubricating system for an internal combustion engine for restricting the overall height of the internal combustion engine.

2. Description of Background Art

A lubricating system for an internal combustion engine is known, for example, as described in Japanese Patent Publication No. Sho 62-49448 entitled "Oil Piping Structure of Engine."

In FIG. 3 of the above-mentioned publication, there is shown a structure in which the bottom 20*a* of a crankcase forms an oil pan, an oil strainer 27 is disposed in the oil pan, and an oil pump 25 is connected to an upper portion of the oil strainer 27.

The technology disclosed in the publication has the following disadvantages: the oil strainer 27 is trapezoidal in side view; a communicating passage (no symbol) for communication of the oil strainer 27 and the oil pump 25, and the oil pump 25 are stacked vertically from the bottom 20*a* of the crankcase to the upper side, and, therefore, the vertical size of the lubricating system becomes large, resulting in that the overall height of the engine becomes large, and the vehicle on which the engine is mounted is necessarily large.

SUMMARY AND OBJECTS OF THE INVENTION

Accordingly, it is an object of the present invention to provide a lubricating system for an internal combustion engine which restricts the overall height of the internal combustion engine by reducing the vertical size of the lubricating system.

In order to attain the above-mentioned object, an internal combustion engine is provided that includes a pair of case halves that are coupled to constitute a crankcase that form an oil pool in the bottom of the crankcase that is fed through a strainer and an oil pump to various portions. The crankcase is provided with a ceiling portion for shutting off the upper side of the oil pool. A window is opened in the ceiling portion of one of the case halves. The strainer is formed in a flat plate like shape and the flat plate like strainer is fitted in the window. One of the case halves is provided with an oil passage through which the oil having passed through the strainer flows roughly horizontally to a suction port of the oil pump. The ceiling portion of one of the case halves is provided with a cutout portion by not casting at a position where the ceiling portion of one of the case halves and the oil pump are adjacent to each other. A plug is fitted in the cutout portion.

The flat plate like strainer is fitted in the window opened in the ceiling portion above the oil pool. One of the case halves is provided with the oil passage through which the oil having passed through the strainer flows roughly horizontally to the oil pump suction port, and one of the case halves is provided with the cutout by not casting at the position where the ceiling portion of one of the case halves and the oil pump are adjacent to each other, whereby the vertical size from the oil pool to the oil pump suction port is reduced as much as possible, and the overall height of the internal combustion engine is restricted.

The present invention includes a plug that is molded as one body with an O-ring for sealing the joint portion of the oil pump suction port and an end portion of the oil passage.

By molding the plug as one body with the O-ring, the number of component parts is reduced, and production cost of the internal combustion engine is reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
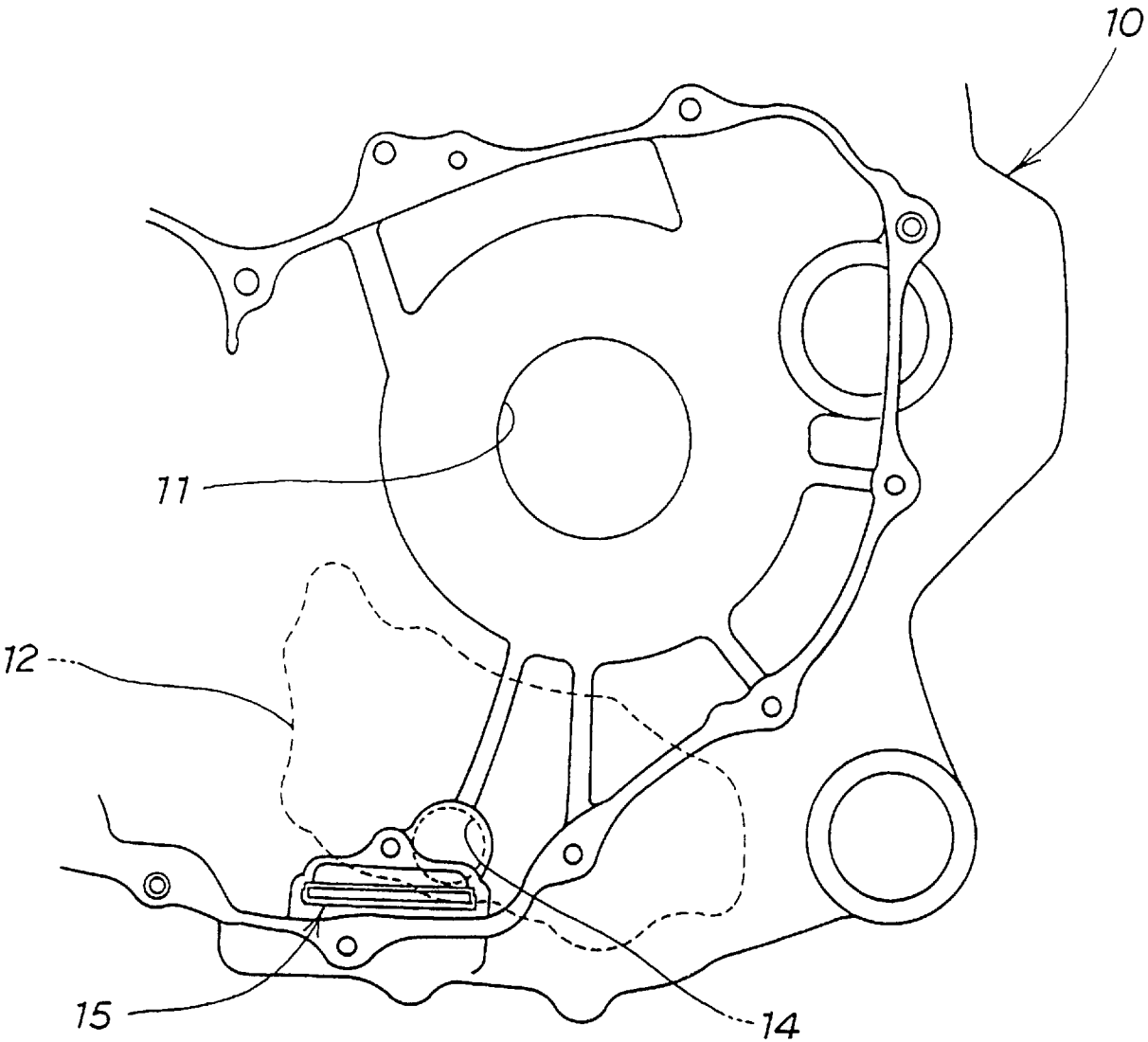
FIG. 1 is a side view of an essential part of a crankcase to which the lubricating system of internal combustion engine according to the invention is fitted.

An embodiment of the present invention will be described below referring to the attached drawings. FIG. 1 is a side view of essential parts of a crankcase to which the lubricating system of internal combustion engine according to the invention is fitted. The crankcase 10 of the internal combustion engine comprises main bearing portions 11, 11 (numeral 11 on the opposite side is not shown) for supporting a crankshaft (not shown), and an oil pump 12 is fitted on the lower inside of one of the main bearing portions 11, 11. An oil suction port 14 is provided for the oil pump 12, and an oil strainer fitting portion 15 is provided for inserting an oil strainer (described later) from the face side toward the back side of the figure.

Figure 2:
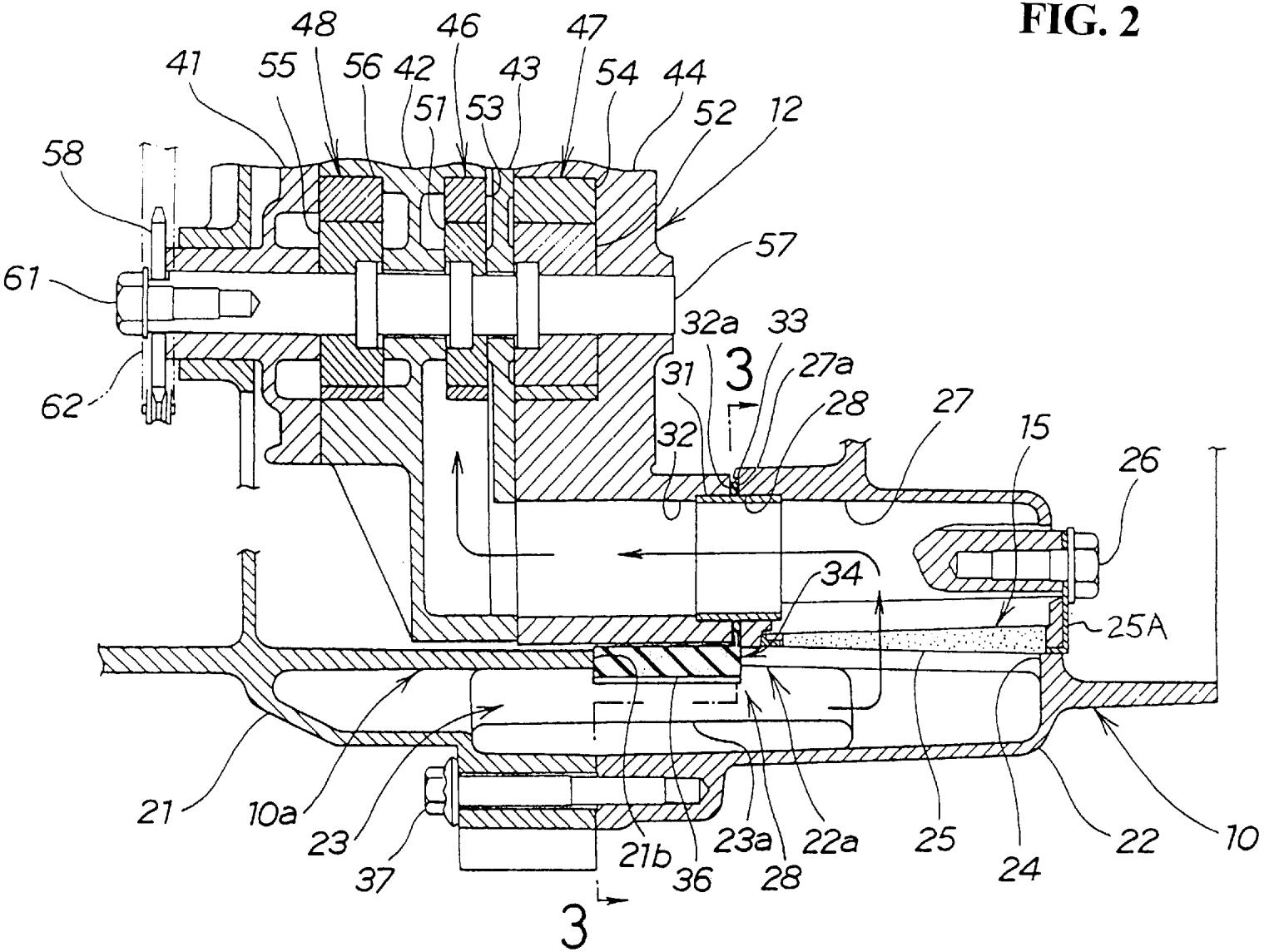
FIG. 2 is a sectional view of an essential part of the lubricating system according to the invention.

FIG. 2 is a sectional view of essential parts of the lubricating system according to the invention, showing the structure as follows. The crankcase 10 is composed of a left case 21 as a case half and a right case 22 as a case half. The left and right cases 21 and 22 are coupled to form an oil pool chamber 23 as an oil pool in a bottom portion. The crankcase 10 is provided with a ceiling portion 10*a* for shutting off the upper side of the oil pool chamber 23. An oil flowing window 24 is provided as a window that is opened in the ceiling portion 22*a* of the right case 22. The oil strainer 25 is fitted to the oil flowing window 24 with a on a retainer 25A with a bolt 26 by roughly horizontally inserting the oil strainer 25 and the retainer 25A from the outside of the right case 22. An oil passage 27 extends roughly horizontally and is provided at an upper portion of the oil strainer 25 of the right case 22. An oil suction port 32 as an oil pump suction port of the oil pump 12 is connected to an outlet 28 of the oil passage 27 through a collar 31. An end portion 27*a* of the oil passage 27 and an end portion 32*a* of the oil suction port 32 are sealed by an O-ring 33. A cutout 34 is provided in the ceiling portion 22*a* on the side of the right case 22 of the oil pool chamber 23. An elastic plug 36 is formed as one body with the O-ring 33 described above and is fitted in the cutout portion 34. A joint surface 21*b* of the right case 22 is provided for mating with the left case 21. A bolt (only one of a plurality of bolts is shown) is provided for fastening the left and right cases 21 and 22 together.

The oil pool chamber 23 comprises, at a lower portion of a side wall, oil inflow holes 23*a* and 23*b* (for symbol 23*b*, see FIG. 3) through which the oil from various portions of the internal combustion engine flows into the oil chamber 23.

The oil strainer 25 is a flat plate like filter means, and is inserted into an oil strainer fitting portion 15 provided roughly horizontally in the right case 22, whereby a vertical size is reduced as much as possible.

The oil passage 27 is formed roughly horizontally between the oil strainer 25 and the oil suction port 32 of the oil pump 12, whereby a vertical size of the oil strainer 25 is reduced as much as possible.

The plug 36 is positioned in the cutout portion 34, whereby an oil flowing passage for smoothing the flow of the oil is formed in the right case 22.

The O-ring 33 and the plug 36 constitute a seal member.

The oil pump 12 is constructed by stacking a first to fourth casings 41 to 44 and mounting scavenging pumps 46 and 47 and a feed pump 48, and is fitted to the left case 21.

The scavenging pumps 46 and 47 are pumps for sucking up the oil filling the oil pool chamber 23 through the oil strainer 25 and the oil passage 27, and are, for example, of the trochoid type comprising inner rotors 51 and 52 and outer rotors 53 and 54 as shown in FIG. 2.

The feed pump 48 is a pump for feeding the oil contained in the above-mentioned oil tank to various portions of the engine, and is, for example, of the trochoid type comprising an inner rotor 55 and an outer rotor 56 as shown in the FIG. 2.

A common pump shaft 57 is provided for the scavenging pumps 46 and 47 and the feed pump 48. A sprocket 58 is fitted to an end portion of the pump shaft 57, and a chain 62 is fitted to the sprocket 58 and a sprocket provided on a crankshaft, whereby the pump shaft 57 is driven by the crankshaft.

The arrows in FIG. 2 represent the flow of the oil. Namely, the oil flows in the order of: oil pool chamber 23→inside of oil strainer 25→oil passage 27→inside of collar 31→oil pump 12 (oil suction port 32→scavenging pumps 46 and 47).

Figure 3:
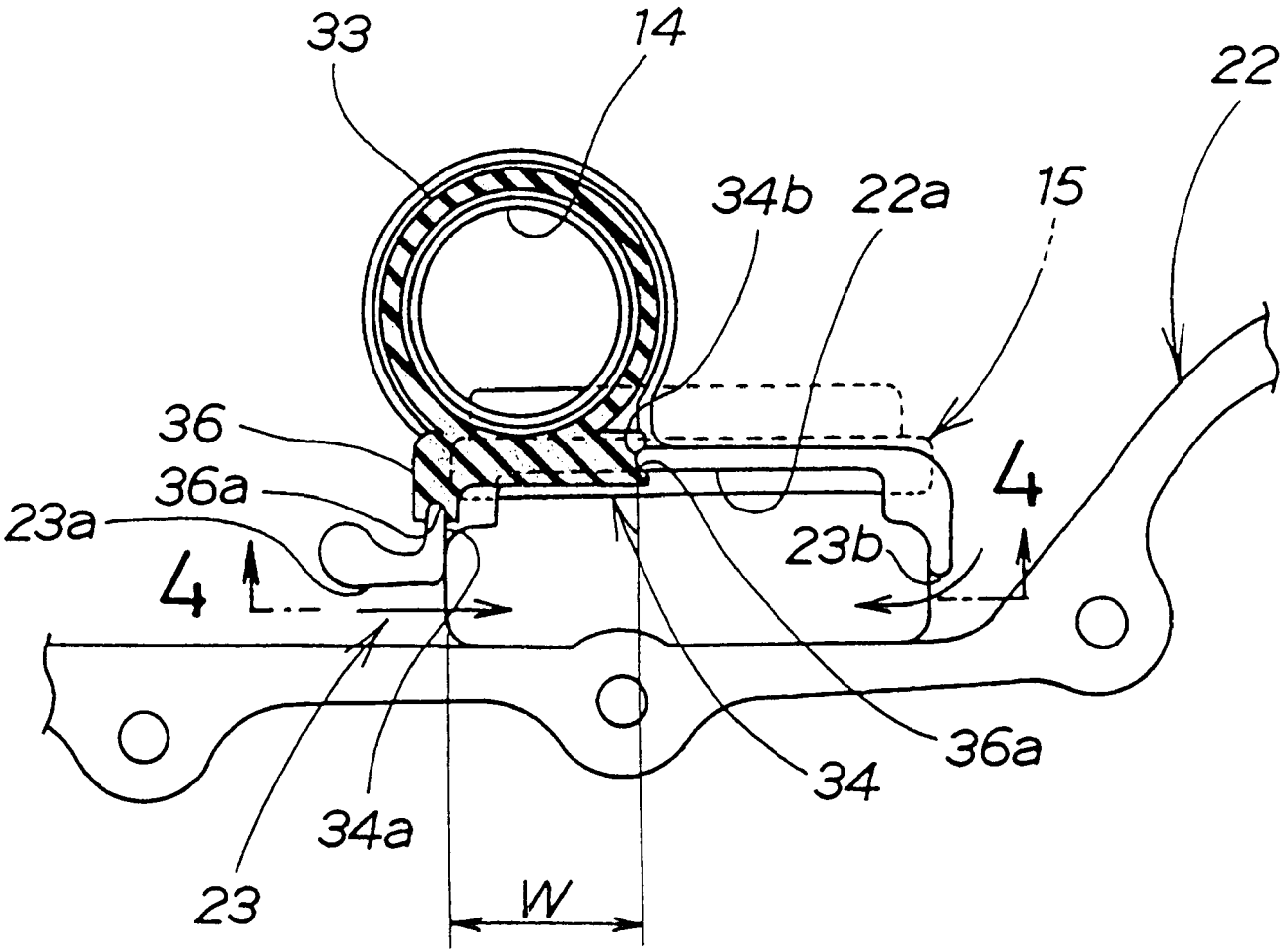
FIG. 3 is a side view of the right case of the lubricating system according to the invention.

FIG. 3 is a side view of the right case of the lubricating system according to the present invention, and shows the portion along line 3—3 of FIG. 2 as viewed from the side of the joint surface of the right case 22.

In the right case 22, the cutout portion 34 is provided in the ceiling portion 22*a* of the oil pool chamber 23, and the plug 36 formed as one body with the O-ring 33 is fitted in the cutout portion 34.

The cutout portion 34 is a portion for fitting the plug 36 therein, in which the width (opening width) of edge portions 34*a* and 34*b* is W, and grooves 36*a* and 36*a* provided in an end face of the plug 36 are fitted to the edge portions 34*a* and 34*b*.

The arrows in the figure represent the flow of the oil. Namely, the oil flows down from various portions of the internal combustion engine, passes through the oil inlet holes 23*a* and 23*b* and pools in the oil pool chamber 23.

Figure 4:
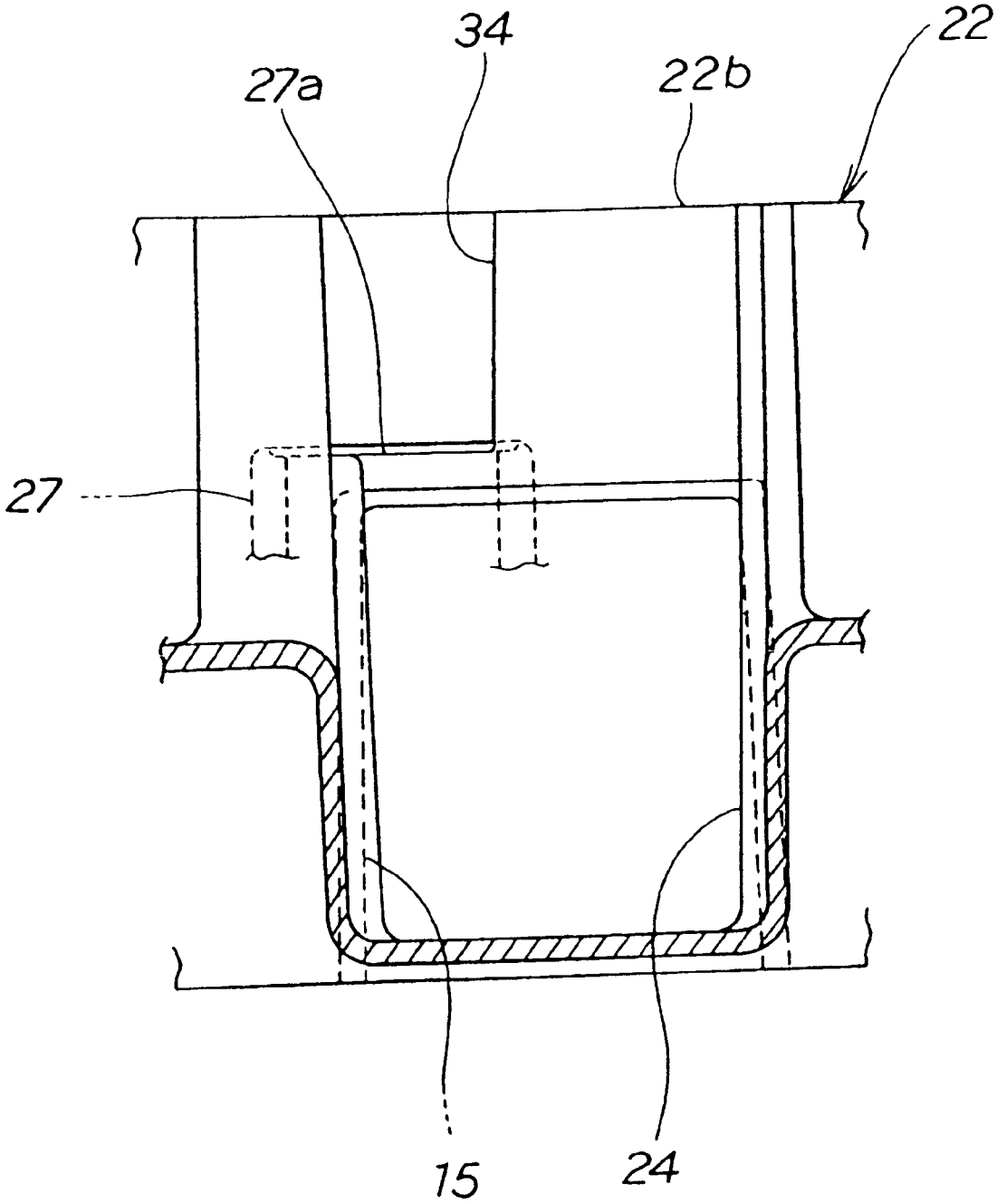
FIG. 4 is a sectional view taken along line 4—4 of FIG. 3.

FIG. 4 is a sectional view taken along line 4—4 of FIG. 3, looking up the oil flowing window 24 and the cutout portion 34.

The cutout portion 34 is formed over the range from the joint surface 22*b* of the right case 22 for mating with the left case 21 (See FIG. 2) to an end portion 27*a* of the oil passage 27.

The oil strainer fitting portion 15 is roughly rectangular in shape, and the oil strainer 25 (See FIG. 2) of roughly the same shape as the oil strainer fitting portion 15 is fitted to the oil strainer fitting portion 15.

The reason why the above-mentioned cutout portion 34 is provided will now be described referring to FIGS. 5 to 8.

Figure 5:
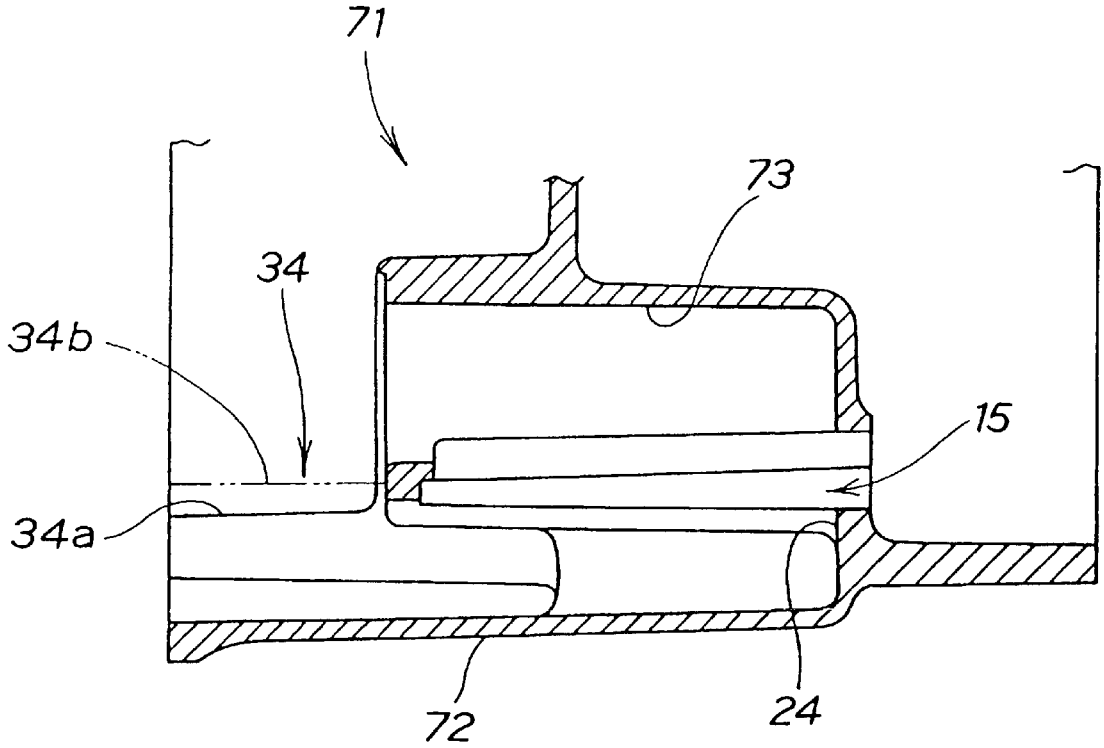
FIG. 5 is a sectional view showing the casting of the right case according to the invention.

FIG. 5 is a sectional view showing the casting of the right case according to the present invention.

A right case casting 71 is cast for producing the right case 22 (See FIG. 2) includes a bottom wall 72 for forming the oil pool chamber 23 (See FIG. 2), the oil flowing window 24, the oil strainer fitting portion 15, a passage 73 to form the oil passage 27 (See FIG. 2), and the cutout portion 34. The cutout portion 34 is formed at the time of casting. In the figure, an edge portion 34*b* of the cutout portion 34 is represented by an imaginary line.

Figure 6:
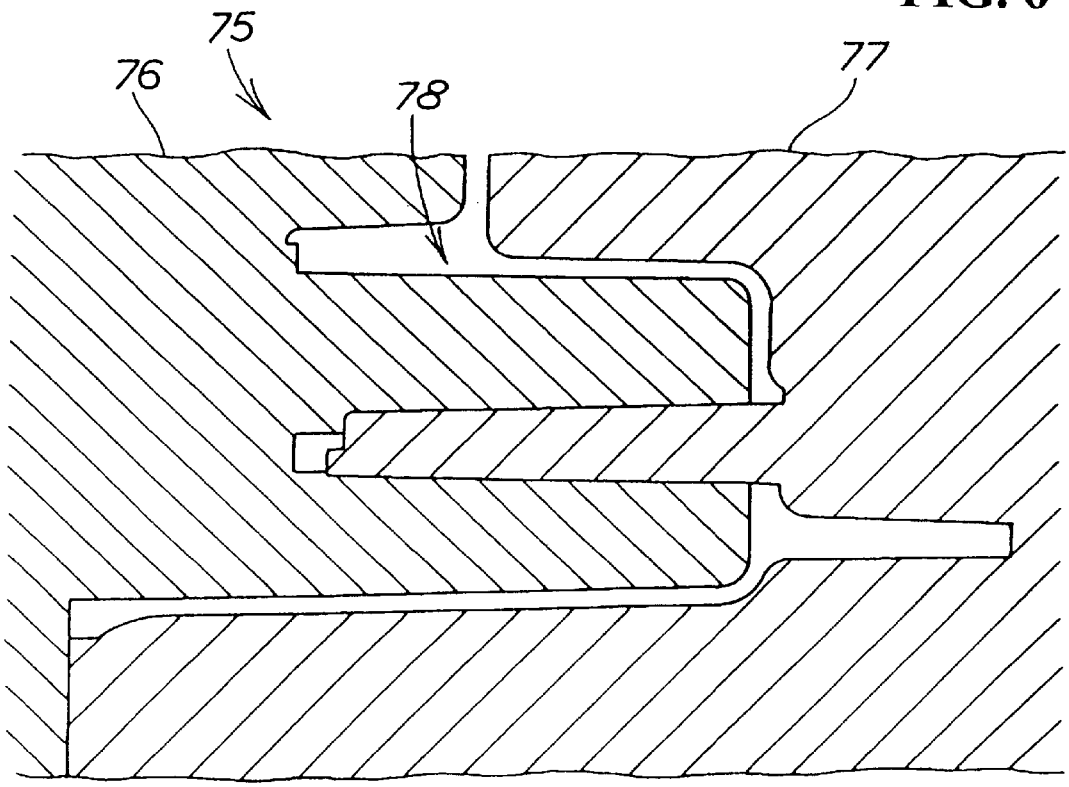
FIG. 6 is a sectional view showing the die for the casting of the right case according to the invention.

FIG. 6 is a sectional view showing a die for the casting of the right case according to the invention.

A right case die 75 comprises a first die 76 and a second die 77 for forming a cavity 78 for casting the right case casting 71 (See FIG. 5).

To cast the right case casting 71, a molten metal of, for example, an aluminum alloy is poured into the cavity 78, and is solidified, then the first die 76 and the second die 77 are opened to the left and the right, and the right case casting 71 is taken out.

Figure 7:
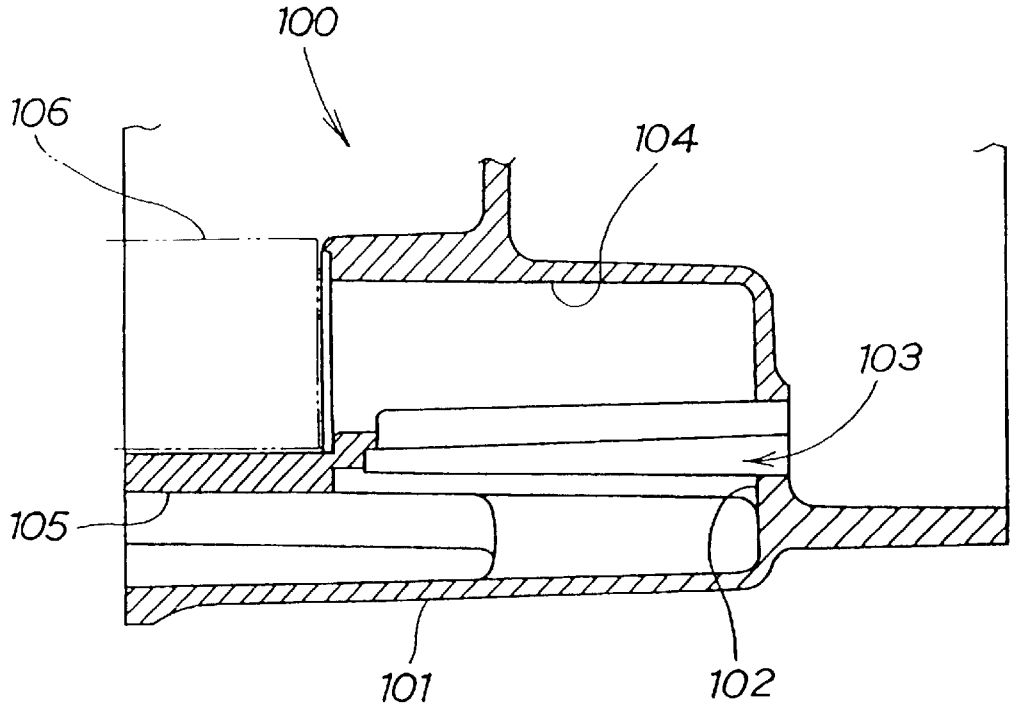
FIG. 7 is a sectional view showing a comparative example of a casting of a right case.

FIG. 7 is a sectional view showing a comparative example of the casting of the right case.

The right case casting 100 comprises a bottom wall 101 for forming the oil pool chamber 23 (See FIG. 2), an oil flowing window 102 opened in the ceiling portion 22*a* (See FIG. 2) of the oil pool chamber 23, an oil strainer fitting portion 103 provided at an upper portion of the oil flowing window 102, a passage 104 to be the oil passage 27 (See FIG. 2) for leading the oil having passed through the oil strainer (not shown) fitted to the oil strainer fitting portion 103 to an oil pump (not shown), and a ceiling portion 105 for shutting off the upper side of the oil pool chamber 23. An imaginary line denotes an oil suction port 106 of the oil pump.

The ceiling portion 105 is a portion formed for eliminating the cutout portion 34 shown in FIG. 5.

Namely, the right case casting 100 in the comparative example is one that would be obtained by adding the ceiling portion 105 to the right case casting 71 of the present invention described referring to FIG. 5.

Figure 8:
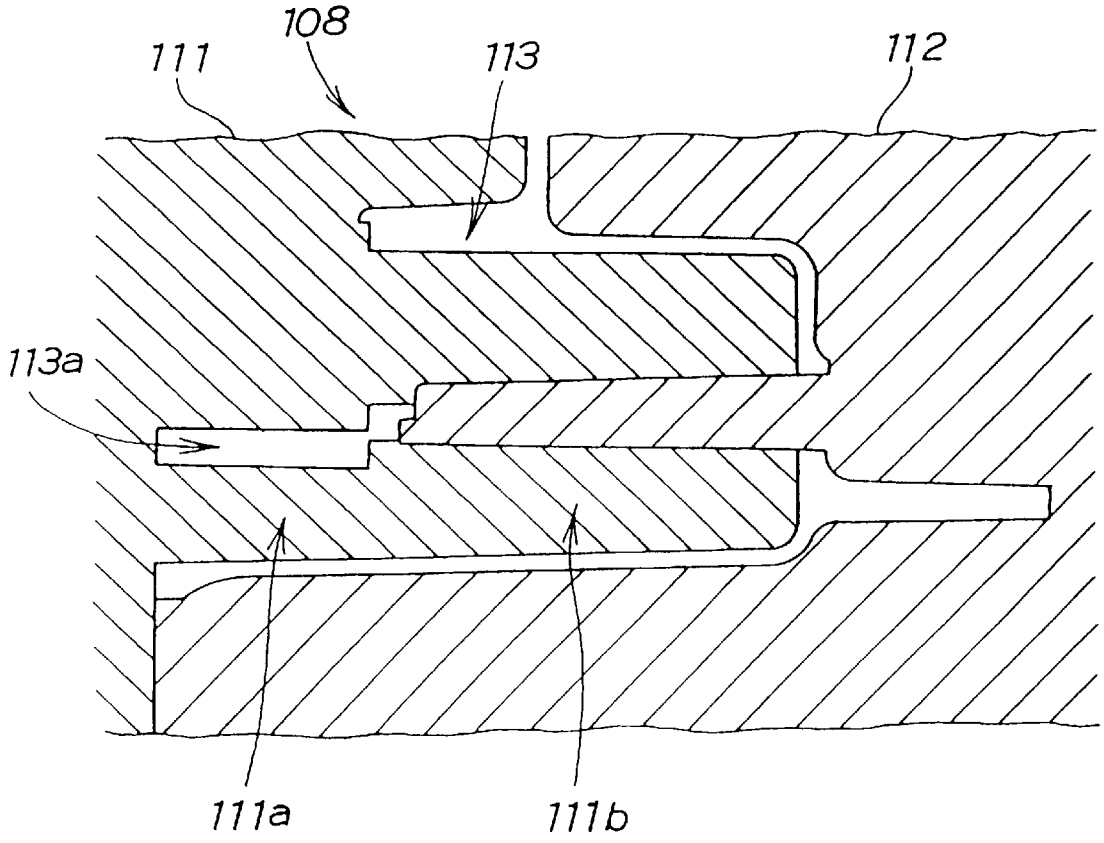
FIG. 8 is a sectional view showing a comparative example of a die for the casting of the right case.

FIG. 8 is a sectional view showing a comparative example of the die for the casting of the right case.

The right case die 108 comprises a first die 111 and a second die 112 for forming a cavity 113 for casting the right case casting 100 (See FIG. 7).

In the case for forming the right case casting 100, a molten metal is poured into the cavity 113 and solidified, whereupon the second die 112 is opened and can be detached from the right case casting 100. However, the first die 111 comprises a small cavity 113*a* constituting the cavity 113, and the first die 111 is provided with a narrow portion 111*a* and a wide portion 111*b* on the deep side of the narrow portion 111*a* by the presence of the small cavity 113*a*, so that the right case casting 100 cannot be detached from the first die 111.

Therefore, as shown in FIG. 6, the first die 76 of the right case die 75 is not provided with a cavity for forming the ceiling portion 22*a* (See FIG. 2) of the right case 22 (See FIG. 2), and the right case 22 is provided with the cutout portion 34 in FIG. 2; namely, the cutout portion 34 is formed by not casting a portion.

As described referring to FIG. 2 above, the present invention is characterized in that, in an internal combustion engine wherein left and right cases 21 and 22 are coupled to form the crankcase 10 with an oil pool in the bottom of the crankcase 10 being fed through the oil strainer 25 and the oil pump 12 to various portions, the crankcase 10 is provided with the ceiling portion 10*a* for shutting off the upper side of the oil pool chamber 23. The oil flowing window 24 is opened in the ceiling portion 22*a* of the right case 22. The oil strainer 25 is formed in a flat plate like shape, the right case 22 is provided with the oil passage 27 through which the oil having passed through the oil strainer 25 flows roughly horizontally to the oil suction port 32. The ceiling portion 22*a* of the right case 22 is provided with the cutout portion 34 by not casting at the position where the ceiling portion 22*a* of the right case 22 and the oil pump 12 are adjacent to each other, and the plug 36 is fitted in the cutout portion 34.

The flat plate like oil strainer 25 is fitted in the oil flowing window 24 of the ceiling 22*a* of the right case 22, the right case 22 is provided with the oil passage 27 through which the oil having passed through the oil strainer 25 flows roughly horizontally to the oil pump suction port 32, and the ceiling portion 22*a* of the right case 22 is provided with the cutout portion 34 by not casting at the position where the ceiling portion 22*a* of the right case 22 and the oil pump 12 are adjacent to each other, whereby the oil flowing passage from the oil pool chamber 23 to the oil suction port 32 is U-shaped, so that the vertical size from the oil pool chamber 23 to the oil suction port 32 can be reduced as much as possible, and the overall height of the internal combustion engine can be restricted.

The present invention is also characterized in that the plug 36 is formed as one body with the O-ring 33 for sealing the joint surface between the oil suction port 32 and the end portion 27*a* of the oil passage 27.

With the plug 36 formed as one body with the O-ring 33, the number of component parts can be reduced, and production cost of the internal combustion engine can be reduced.

While the right case 22 is provided with the oil flowing window 24, the oil passage 27 and the cutout portion 34, the oil strainer 25 is provided in the right case 22 and the oil pump 12 is fitted to the left case 21 as shown in FIG. 2 in the present embodiment of the invention, this is not limitative. Namely, the left case may be provided with the oil flowing window 24, the oil passage 27 and the cutout portion 34, the oil strainer 25 may be provided in the left case, and the oil pump 12 may be fitted to the right case.

The present invention constituted as above displays the following effects.

The lubricating system of internal combustion engine provides a flat plate like strainer that is fitted to the window opened in the ceiling portion above the oil pool. One of the case halves is provided with the oil passage through which the oil having passed through the strainer flows roughly horizontally to the oil pump suction port. The ceiling portion of one of the case halves is provided with the cutout portion by not casting at the position where the ceiling portion of one of the case halves and the oil pump are adjacent to each other, whereby the vertical size from the oil pool to the oil pump suction port can be reduced as much as possible, and the overall size of the internal combustion engine can be restricted.

The lubricating system of internal combustion engine provides a plug that is formed as one body with the O-ring for sealing the joint portion between the oil pump suction port and the end portion of the oil passage, whereby the number of component parts can be reduced, and production cost of the internal combustion engine can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating system for an internal combustion engine comprising:

a pair of case halves coupled to constitute a crankcase;

an oil pool formed in a bottom of said crankcase is fed through a strainer and an oil pump for lubrication to various portions;

said crankcase being provided with a ceiling portion for closing an upper side of the oil pool, an opening in said ceiling portion of one of said case halves, said strainer is formed in a flat plate like shape, said flat plate like strainer is fitted in said opening, one of said case halves is provided with an oil passage through which the oil having passed through said strainer flows roughly horizontally to a suction port of said oil pump, said ceiling portion of one of said case halves is provided with a cutout portion at a position where said ceiling portion of one of said case halves and said oil pump are adjacent to each other, and a plug is fitted in said cutout portion.

2. The lubricating system for an internal combustion engine according to claim 1, wherein said plug is molded as one body with an O-ring for sealing a joint portion of said oil pump suction port and an end portion of said oil passage.

3. The lubricating system for an internal combustion engine according to claim 2, wherein said plug positioned in said cutout portion includes an enlarged section extending within said cutout portion and an O-ring section integrally formed with said enlarged section and projecting upwardly therefrom, said O-ring section engages an interior surface of said oil passage for forming the seal between the joint portion of the oil pump suction port and an end portion of said oil passage.

4. The lubricating system for an internal combustion engine according to claim 3, wherein said plug includes a first end face and a second end face, each of said first end face and said second end face including a groove for mating with edge portions of said cutout portion.

5. The lubricating system for an internal combustion engine according to claim 3, wherein said plug extends in a first direction into said cutout portion and said O-ring projects forwardly in a second direction and upwardly from one end of said plug for forming the seal between the joint portion of the oil pump suction port and an end portion of said oil passage.

6. The lubricating system for an internal combustion engine according to claim 1, and further including a side opening formed in said crankcase and a retainer for mounting to at least a portion of said strainer and for securing the strainer relative to the side opening in the crankcase and the opening in the ceiling portion of one of the case halves.

7. The lubricating system for an internal combustion engine according to claim 6, wherein the side opening is formed in an accessible position relative to said crankcase and further including a securing member for mounting the retainer and strainer relative to said side opening and for enabling removal of said retainer and strainer for replacement.

8. The lubricating system for an internal combustion engine according to claim 1, wherein said strainer is substantially rectangular in shape and includes a cross section that is wedge shaped.

9. A lubricating system for an internal combustion engine comprising:

a pair of casings mounted at a joint relative to each other for forming a crankcase;

an oil pool formed in a bottom of said crankcase;

a passageway formed for supplying oil from said oil pool for lubrication to various portions of the internal combustion engine;

a ceiling portion formed in said passageway for closing an upper side of the oil pool;

an opening formed in said ceiling portion;

a strainer fitted within said opening formed in said ceiling portion, said strainer being formed as a flat plate like shape;

said passageway providing an oil passage through which oil having passed through said strainer flows substantially horizontally to various portions of the internal combustion engine;

a cutout portion being formed in said ceiling portion in said passageway, said cutout portion being formed at a position where said joint of said pair of casings is formed; and a plug is fitted in said cutout portion for sealing said joint.

10. The lubricating system for an internal combustion engine according to claim 9, wherein said plug is molded as one body with an O-ring for sealing the joint portion between said pair of casings.

11. The lubricating system for an internal combustion engine according to claim 10, wherein said plug positioned in said cutout portion includes an enlarged section extending within said cutout portion and an O-ring section integrally formed with said enlarged section and projecting upwardly therefrom, said O-ring section engages an interior surface of said oil passage for forming the seal between the joint portion of the casings.

12. The lubricating system for an internal combustion engine according to claim 11, wherein said plug includes a first end face and a second end face, each of said first end face and said second end face including a groove for mating with edge portions of said cutout portion.

13. The lubricating system for an internal combustion engine according to claim 11, wherein said plug extends in a first direction into said cutout portion and said O-ring projects forwardly in a second direction and upwardly from one end of said plug for forming the seal between the joint portion of the casings.

14. The lubricating system for an internal combustion engine according to claim 9, and further including a side opening formed in said crankcase and a retainer for mounting to at least a portion of said strainer and for securing the strainer relative to the side opening in the crankcase and the opening in the ceiling portion of one of the casings.

15. The lubricating system for an internal combustion engine according to claim 14, wherein the side opening is formed in an accessible position relative to said crankcase and further including a securing member for mounting the retainer and strainer relative to said side opening and for enabling removal of said retainer and strainer for replacement.

16. The lubricating system for an internal combustion engine according to claim 9, wherein said strainer is substantially rectangular in shape and includes a cross section that is wedge shaped.

* * * * *